US010370942B2

(12) United States Patent
Lin et al.

(10) Patent No.: US 10,370,942 B2
(45) Date of Patent: Aug. 6, 2019

(54) METHOD FOR INTEGRATED DRILLING, FLUSHING, SLOTTING AND THERMAL INJECTION FOR COALBED GAS EXTRACTION

(71) Applicant: China University of Mining and Technology, Xuzhou, Jiangsu (CN)

(72) Inventors: Baiquan Lin, Jiangsu (CN); Ting Liu, Jiangsu (CN); Quanle Zou, Jiangsu (CN); Chang Guo, Jiangsu (CN); Chuanjie Zhu, Jiangsu (CN); Hao Yao, Jiangsu (CN); Fazhi Yan, Jiangsu (CN); Jia Kong, Jiangsu (CN); Yidu Hong, Jiangsu (CN)

(73) Assignee: China University of Mining and Technology, Xuzhou, Jiangsu (CN)

( * ) Notice: Subject to any disclaimer, the term of this patent is extended or adjusted under 35 U.S.C. 154(b) by 249 days.

(21) Appl. No.: 15/325,506

(22) PCT Filed: Dec. 21, 2015

(86) PCT No.: PCT/CN2015/098102

§ 371 (c)(1),
(2) Date: Jan. 11, 2017

(87) PCT Pub. No.: WO2016/110183

PCT Pub. Date: Jul. 14, 2016

(65) Prior Publication Data

US 2017/0145794 A1 May 25, 2017

(30) Foreign Application Priority Data

Jan. 6, 2015 (CN) ..... 2015 1 0005682

(51) Int. Cl.
*E21B 43/24* (2006.01)
*E21B 43/30* (2006.01)
(Continued)

(52) U.S. Cl.
CPC ..... *E21B 43/006* (2013.01); *E21B 43/24* (2013.01); *E21B 43/30* (2013.01); *E21F 7/00* (2013.01); *E21B 7/00* (2013.01)

(58) Field of Classification Search
CPC ..... E21B 43/24; E21B 43/30; E21B 43/006
See application file for complete search history.

(56) References Cited

U.S. PATENT DOCUMENTS 3,283,814 A * 11/1966 Schlicht ..... E21B 43/2403 166/247
9,417,358 B2 8/2016 Lin et al.
(Continued)

FOREIGN PATENT DOCUMENTS

CN 101555783 A 10/2009
CN 101832149 A 9/2010
(Continued)

OTHER PUBLICATIONS

PCT International Search Report, PCT/CN2015/098102, dated Mar. 29, 2016.
PCT Written Opinion, PCT/CN2015/098102, dated Mar. 29, 2016.

*Primary Examiner* — Catherine Loikith
(74) *Attorney, Agent, or Firm* — TraskBritt

(57) ABSTRACT

A method for combining integrated drilling, flushing and slotting with thermal injection to enhance coalbed gas extraction, applicable to managing gas extraction from microporous, low-permeability, high-adsorption coalbed areas. A gas extraction borehole is drilled within a certain distance of a predetermined drilling, flushing and slotting borehole, and, once sealed, is used for gas extraction. An integrated drilling, flushing and slotting drill bit is used to sink the borehole, which is then sealed. Concentration variation in the gas extraction borehole is monitored in real time, and when concentration is below 30%, borehole is opened and high-temperature steam is injected by means of
(Continued)

a steam generator, after which the borehole is again closed. Drilling a drilling, flushing and slotting borehole increases pressure relief space and the surface of exposed coal, relieves stress on the coal body, and increases gas permeability of the coalbed, while the injection of high-temperature steam promotes gas desorption in the coal body, promotes crack propagation around the borehole, and increases channels for gas flow, thus achieving highly efficient extraction of gas from the coalbed.

9 Claims, 2 Drawing Sheets

(51) Int. Cl.

| | |
|---|---|
| ***E21B 43/00*** | (2006.01) |
| ***E21F 7/00*** | (2006.01) |
| *E21B 7/00* | (2006.01) |

(56) References Cited

U.S. PATENT DOCUMENTS

| | | | | |
|---|---|---|---|---|
| 2013/0061592 | A1* | 3/2013 | Mehta | E21B 43/243 60/648 |
| 2015/0159470 | A1 | 6/2015 | Lin et al. | |
| 2016/0136575 | A1 | 5/2016 | Lin et al. | |

FOREIGN PATENT DOCUMENTS

| | | | |
|---|---|---|---|
| CN | 102400669 | A | 4/2012 |
| CN | 103696800 | A | 4/2014 |
| CN | 104563990 | A | 4/2015 |
| EP | 2527586 | A1 | 11/2012 |
| RU | 2528760 | C1 | 9/2014 |
| WO | 2016110183 | A1 | 7/2016 |

* cited by examiner

METHOD FOR INTEGRATED DRILLING, FLUSHING, SLOTTING AND THERMAL INJECTION FOR COALBED GAS EXTRACTION

CROSS-REFERENCE TO RELATED APPLICATIONS

This application is a national phase entry under 35 U.S.C. § 371 of International Patent Application PCT/CN2015/098102, filed Dec. 21, 2015, designating the United States of America and published as International Patent Publication WO 2016/110183 A1 on Jul. 14, 2016, which claims the benefit under Article 8 of the Patent Cooperation Treaty to Chinese Patent Application Serial No. 201510005682.x, filed Jan. 6, 2015.

TECHNICAL FIELD

This disclosure relates to a method for coal seam gas extraction enhanced by integrated drilling, flushing, slotting and heat injection in combination, particularly applicable to gas control in micro-porosity, low-permeability, high-absorptivity and high-gas coal seam areas.

BACKGROUND

The gas occurrence in the coal seams in China has characteristics including micro-porosity, low-permeability, and high-absorptivity. The average permeability of the coal seams is $1.1974\times10^{-18}$ to $1.1596\times10^{-14}m^2$, and the gas pre-extraction rate is very low, having a strong impact on the safe production in coal mines.

At present, hydraulic measures, represented by hydraulic slotting and hydraulic flushing, etc., have been widely applied in the gas control process in the coal mining fields in China, owing to their efficient pressure relief and permeability improvement effect. However, owing to the fact that the geologic conditions of the coal seams in China are complicated and the permeability of the coal seams is low, if only a single hydraulic measure is used, because of the limited pressure relief and permeability improvement effect incurred by the limited fracturing ability of water-jet cutting and high-pressure water impact, the gas extraction concentration will be low, the extraction cycle will be long, and the requirement for intensive coal mining cannot be met.

In addition, relevant research findings have indicated that the pore structures of coal masses in China are mainly micro-porous structures in which a large quantity of gas adsorption spaces are formed and the gas absorptivity of the coal mass is very strong, resulting in high gas content in the coal mass and difficult gas desorption. Consequently, it is difficult to extract the gasses from the coal seams, the flow rate of gas extraction from a single borehole is quickly attenuated, and the resulting extraction is poor. Available research findings have demonstrated that the gas desorption from coal mass can be promoted and the quantity of gas extraction can be increased as the temperature of the coal mass increases.

BRIEF SUMMARY

Technical problem: in order to overcome the drawbacks in the prior art, this disclosure provides a method for coal seam gas extraction enhanced by integrated drilling, flushing, slotting, and heat injection in combination, which is easy to operate, attains a remarkable permeability improvement effect, and greatly improves the resulting gas extraction.

Technical solution: the method for coal seam gas extraction enhanced by integrated drilling, flushing, slotting and heat injection in combination provided in this disclosure comprises drilling, hydraulic flushing, hydraulic slotting, sealing, and gas extraction, through the following steps:

a. selecting a site of heat injection borehole in the extraction lane on the coal seam floor, drilling approximately 3 to 6 gas extraction boreholes around the heat injection borehole in the extraction lane on the coal seam floor through the coal seam floor toward the coal seam to the roof of the coal seam, and then withdrawing the drill stem, sealing the gas extraction boreholes in a conventional way, and carrying out gas extraction from the gas extraction boreholes;

b. drilling a heat injection borehole from the extraction lane on the coal seam floor through the coal seam floor and the coal seam to the roof of the coal seam with an integrated drilling and slotting drill bit;

c. injecting pressurized water at a pressure of approximately 5 MPa to 10 MPa while withdrawing the drill stem, repeatedly pulling and rotating the drill stem to carry out hydraulic flushing on the coal seam section so that the heat injection borehole forms a drilling and flushing borehole having a bore diameter of 0.4 m to 0.8 m;

d. adjusting the water pressure to 15 MPa to 25 MPa, repeatedly pulling the drill stem to cut a slot parallel to the axial direction of the borehole in the flushing borehole; turning the drill stem 45° to 180° and repeatedly pulling the drill stem to cut several slots parallel to the axial direction of the borehole, so as to form a drilling, flushing, and slotting borehole; then, sealing the drilling, flushing, and slotting borehole;

e. monitoring the gas concentration change in the gas extraction borehole in real time; opening the orifice of the drilling, flushing, and slotting borehole when the gas concentration in the borehole is lower than 30%, and injecting high-temperature steam into the drilling, flushing, and slotting borehole via a high-temperature heat-insulating heat supply pipeline from a steam generator for approximately 1 to 3 hours, in order to increase the gas concentration in the gas extraction borehole.

The slots cut parallel to the axial direction of the borehole have a width of 0.5 m to 1 m and a height of 0.02 m to 0.05 m.

The number of slots are 2 to 8.

The temperature of high-temperature steam is 150° C. to 450° C.

Beneficial effects: In this disclosure, pressure relief and permeability improvement through integrated low-pressure drilling, medium-pressure flushing, and high-pressure slotting is realized by flushing a drilled borehole and slotting in the flushed borehole. The pressure relief space is enlarged by hydraulic flushing, the exposed area of the coal mass is enlarged by slotting, thereby significantly enlarging the scope of pressure relief and permeability improvement of a single borehole. Furthermore, the pressure relief space formed by hydraulic flushing and hydraulic slotting can significantly increase the contact surface between the coal mass and the high-temperature steam and enlarge the acting scope of the high-temperature steam, thereby promoting gas desorption from the coal mass. The method provided in this disclosure overcomes the limitation of a single permeability improvement technique, significantly enlarges the scope of pressure relief of a single borehole and the effective exposed area of the coal mass by integrated low-pressure drilling, medium-pressure flushing, and high-pressure slotting, creating a favorable prior condition for gas desorption from the coal mass driven by hot steam. With the method provided in this disclosure, the gas extraction flow from a single borehole can be increased by 1 to 2 times, the gas extraction concentration can be increased by 30% to 50%, and the gas pre-extraction rate can be improved by 40% to 70%. The method is easy to operate, has high practicability, and has an extensive application prospect, especially for gas control in micro-porous, low-permeability, high-absorptivity and high gas outbursting loose coal seam areas.

Figure 1:
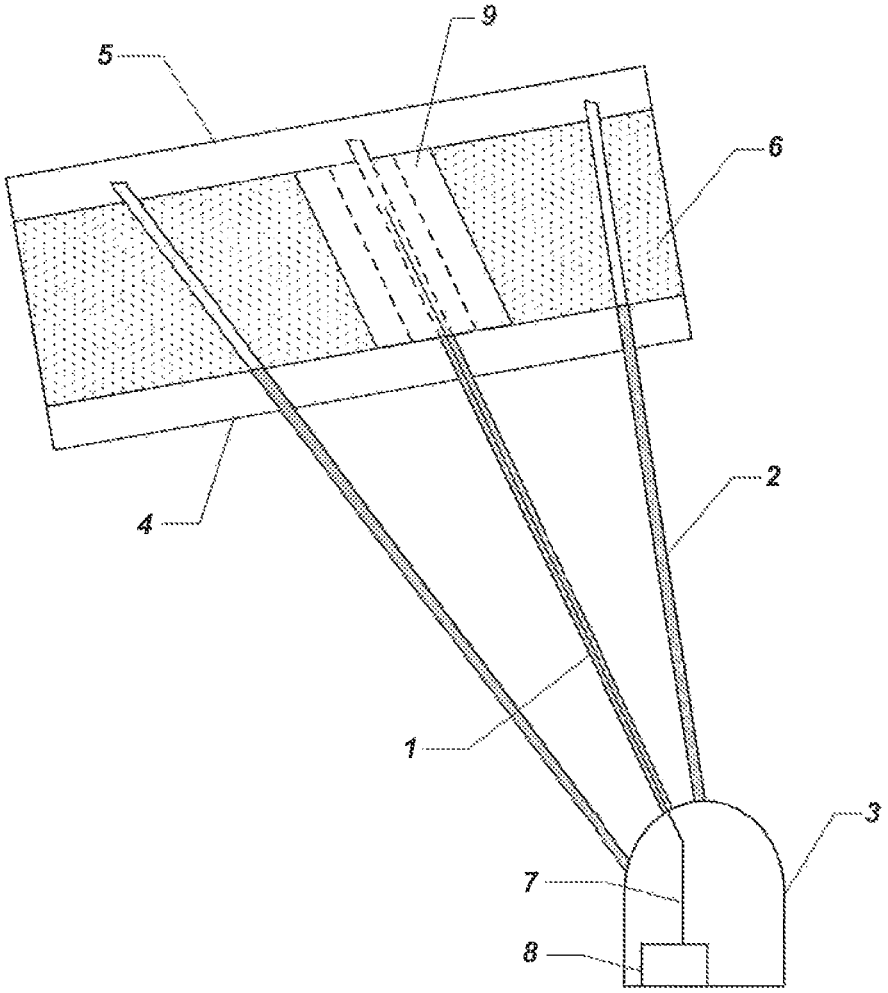
FIG. 1 is a cross-sectional view according to this disclosure.
Figure 2:
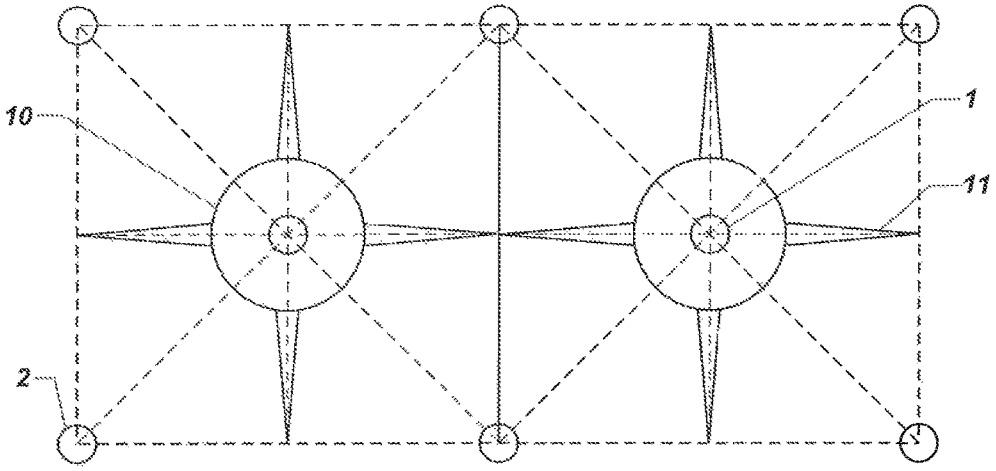
FIG. 2 is a schematic diagram of borehole position according to this disclosure.

Among the figures, the following reference numerals and definitions are used: 1—heat injection borehole; 2—gas extraction borehole; 3—extraction lane on coal seam floor; 4—coal seam floor; 5—roof of coal seam; 6—coal seam; 7—high-temperature heat-insulating heat supply pipeline; 8—steam generator; 9—drilling, flushing, and slotting borehole; 10—drilling and flushing borehole; and 11—slot.

DETAILED DESCRIPTION

This disclosure will be hereinafter detailed in an embodiment with reference to the accompanying drawings.

The method for coal seam gas extraction enhanced by integrated drilling, flushing, slotting and heat injection in combination provided in this disclosure comprises sequentially drilling, hydraulic flushing, hydraulic slotting, sealing, injecting hot steam, and gas extraction in a coal seam, through the following steps:

a. selecting a site of heat injection borehole 1 in the extraction lane 3 on the coal seam floor, drilling approximately 3 to 6 gas extraction boreholes 2 around the heat injection borehole 1 in the extraction lane 3 on the coal seam floor through the coal seam floor 4 toward the coal seam 6 to the roof 5 of the coal seam, and then withdrawing the drill stem, sealing the boreholes 2 in a conventional way, and carrying out gas extraction from the gas extraction boreholes 2;

b. drilling a heat injection borehole 1 from the extraction lane 3 on the coal seam floor through the coal seam floor 4 and the coal seam 6 to the roof 5 of the coal seam with an integrated drilling and slotting drill bit;

c. injecting pressurized water at a pressure of 5 MPa to 10 MPa into the borehole while withdrawing the drill stem, pulling and rotating the drill stem repeatedly to carry out hydraulic flushing on the section of the coal seam 6 to enlarge the bore radius, so that the heat injection borehole 1 forms a drilling and flushing borehole 10 having a bore diameter of approximately 0.4 m to 0.8 m;

d. adjusting the water pressure to 15 MPa to 25 MPa, repeatedly pulling the drill stem to cut a symmetric slot 11, which is parallel to the axial direction of the borehole in the drilling and flushing borehole 10; turning the drill stem for 45° to 180° and pulling the drill stem repeatedly to cut several slots 11 parallel to the axial direction of the borehole, so as to form a drilling, flushing, and slotting borehole 9; then, sealing the drilling, flushing, and slotting borehole 9; the slots 11 parallel to the axial direction of the borehole having a width of 0.5 m to 1 m and a height of approximately 0.02 m to 0.05 m, and having a quantity of 2 to 8.

e. monitoring the gas concentration change in the gas extraction borehole 2 in real time; opening the orifice of the drilling, flushing, and slotting borehole 9 when the gas concentration in the borehole 9 is lower than 30%, and injecting high-temperature steam at 150° C. to 450° C. into the drilling, flushing, and slotting borehole 9 via a high-temperature heat insulating heat supply pipeline 7 from a steam generator 8 for approximately 1 to 3 hours, in order to increase the gas concentration in the gas extraction borehole 2 by means of the high-temperature steam.

The invention claimed is:

1. A method for coal seam gas extraction enhanced by integrated drilling, flushing, slotting and heat injection in combination, comprising drilling, hydraulic flushing, hydraulic slotting, sealing, and gas extraction, through the following steps:

a. selecting a site of a heat injection borehole in an extraction lane of a coal seam floor, drilling 3 to 6 gas extraction boreholes around the heat injection borehole in the extraction lane of the coal seam floor through the coal seam floor toward a coal seam to a roof of the coal seam, and then withdrawing a drill stem, sealing the gas extraction boreholes in a conventional way, and carrying out gas extraction from the gas extraction boreholes;

b. drilling the heat injection borehole from the extraction lane of the coal seam floor through the coal seam floor and the coal seam to the roof of the coal seam with an integrated drilling and slotting drill bit;

c. injecting pressurized water at a pressure of 5 MPa to 10 MPa while withdrawing the drill stem, pulling and rotating the drill stem repeatedly to carry out hydraulic flushing on a section of the coal seam so that the heat injection borehole forms a drilling and flushing borehole having a bore diameter of approximately 0.4 m to 0.8 m;

d. adjusting the water pressure from 15 MPa to 25 MPa, pulling the drill stem repeatedly to cut a slot parallel to the axial direction of the drilling and flushing borehole; turning the drill stem for 45° to 180° and pulling the drill stem repeatedly to cut several slots parallel to the axial direction of the drilling and flushing borehole so as to form a drilling, flushing, and slotting borehole; then, sealing the drilling, flushing, and slotting borehole; and e. monitoring gas concentration change in the gas extraction borehole in real time; opening an orifice of the drilling, flushing, and slotting borehole when the gas concentration in the drilling, flushing, and slotting borehole is lower than 30%, and injecting high-temperature steam into the drilling, flushing, and slotting borehole via a high-temperature heat-insulating heat supply pipeline from a steam generator for 1 to 3 hours, in order to increase the gas concentration in the gas extraction borehole.

2. The method according to claim 1, wherein the slots have a width of approximately 0.5 m to 1 m and a height of approximately 0.02 m to 0.05 m.

3. The method according to claim 2, wherein the number of the slots parallel to the axial direction of the drilling and flushing borehole is from two (2) to eight (8).

4. The method according to claim 1, wherein the number of the slots parallel to the axial direction of the drilling and flushing borehole is 2 to 8.

5. The method according to claim 1, wherein the high-temperature steam has a temperature of 150° C. to 450° C.

6. A method of coal seam gas extraction, the method comprising:

drilling from three to six gas extraction boreholes around a heat injection borehole in an extraction lane of a coal seam floor through the coal seam floor toward a coal seam to a roof of the coal seam, withdrawing a drill stem, sealing the gas extraction boreholes, and extracting gas from the gas extraction boreholes;

drilling the heat injection borehole from the extraction lane of the coal seam floor through the coal seam floor and the coal seam proximate the coal seam roof with an integrated drilling and slotting drill bit;

injecting water into the heat injection borehole at a water pressure of from 5 MPa to 10 MPa while withdrawing the drill stem, pulling and rotating the drill stem repeatedly to carry out hydraulic flushing on a section of the coal seam so that the heat injection borehole forms a drilling and flushing borehole having a bore diameter of approximately 0.4 m to 0.8 m;

adjusting the water pressure from 15 MPa to 25 MPa, pulling the drill stem repeatedly to cut a slot parallel to the axial direction of the drilling and flushing borehole;

turning the drill stem for 45° to 180° and pulling the drill stem repeatedly to cut several slots parallel to the axial direction of the drilling and flushing borehole so as to form a drilling, flushing, and slotting borehole;

then, sealing the drilling, flushing, and slotting borehole;

monitoring the gas concentration change in the gas extraction borehole; and opening an orifice of the drilling, flushing, and slotting borehole when the gas concentration in the drilling, flushing, and slotting borehole is lower than 30%, and injecting high-temperature steam therein via a high-temperature heat-insulating heat supply pipeline for from one (1) to three (3) hours so as to increase the gas concentration in the gas extraction borehole.

7. The method according to claim 6, wherein the slots have a width of approximately 0.5 m to 1 m and a height of approximately 0.02 m to 0.05 m.

8. The method according to claim 6, wherein the number of the slots parallel to the axial direction of the drilling and flushing borehole is from two (2) to eight (8).

9. The method according to claim 6, wherein the high-temperature steam has a temperature of from 150° C. to 450° C.

* * * * *